US006085392A

United States Patent [19]

Strobel et al.

[11] Patent Number: 6,085,392

[45] Date of Patent: Jul. 11, 2000

[54] TEXTILE STRETCH MACHINE WITH A DRIVE MECHANISM HOUSED IN A DRIVE ENCLOSURE

[75] Inventors: Michael Maria Strobel, Eichstätt; Rudolf Becker, Ingolstadt, both of Germany

[73] Assignee: Rieter Ingolstadt Spinnereimaschinenbau AG, Ingolstadt, Germany

[21] Appl. No.: 09/216,783

[22] Filed: Dec. 18, 1998

[30] Foreign Application Priority Data

Dec. 18, 1997 [DE] Germany ..... 197 56 432

[51] Int. Cl.[7] ..... D01H 5/00

[52] U.S. Cl. ..... 19/236; 19/65 A; 15/301

[58] Field of Search ..... 15/301; 19/65 A, 19/159 A, 159 R, 157, 236, 237, 242, 243, 263; 62/DIG. 16; 165/80.3; 361/688, 691, 694, 695; 57/304, 308

[56] References Cited

U.S. PATENT DOCUMENTS 4,480,355 11/1984 Vignon et al. .
4,853,566 8/1989 Dinkelmann et al. .

FOREIGN PATENT DOCUMENTS

3815199A1 11/1989 Germany .
3827902A1 2/1990 Germany .
285619 A5 12/1990 Germany .
2086440 5/1982 United Kingdom .

OTHER PUBLICATIONS

German Patent Office Search Report, May 6, 1999.

German Patent Office Search Report, Apr. 7, 1998.

U.S. application Ser. No. 09/126,137.

*Primary Examiner*—Michael A. Neas
*Assistant Examiner*—Gary L. Welch
*Attorney, Agent, or Firm*—Dority & Manning

[57] ABSTRACT

The present invention concerns a stretch machine with a drive mechanism which is placed in a drive enclosure (3). This drive is covered by a movable top (2), which lies with its edge areas (24) on a stationary part (10) of the stretch machine and which top carries a blower (4) with at least one suction side and one discharge side. The blower stands with its suction side in connection with a filter (5) and with its discharge side open to the interior of the drive enclosure (3). Within the drive enclosure is provided an air distribution system (6). This is so arranged and so oriented that the blower (4) produces, in the entire peripheral area of the cover (2), an effect which is essentially of uniform strength. The blower 4 is provided with a control apparatus (71) for a reversal of its direction of impelling air.

17 Claims, 3 Drawing Sheets

TEXTILE STRETCH MACHINE WITH A DRIVE MECHANISM HOUSED IN A DRIVE ENCLOSURE

BACKGROUND OF THE INVENTION

The present invention concerns a textile stretch machine having a drive mechanism in a drive enclosure and which said machine can be covered by a movable top with the edge areas thereof on a stationary part of the stretch machine.

In the case of stretch machines, the individual drives, such as main power drive, over drive, i.e., for the can exchange, stretch works drive and turntable drive, etc. are covered by at least a pivotable top. As a rule, such coverings are made of sheet metal, so that, on the one hand, they can be manipulated without the use of too much strength, and on the other hand, sheet metal permits them to be fabricated at low cost. Since the drives require considerable space, then the top must correspondingly possess large dimensions, in order to make access possible to all the individual drive assemblies. A top meeting these requirements, to a certain extent, even when means have been exercised to reinforce its periphery, is flexible, and on this account lies not fully sealed on its under support, which said support is comprised of a stationary part of the stretch machine. Cracks and gaps are present, through which air can penetrate into the protective drive enclosure. Since the space which surrounds the stretch machine cannot be kept completely free of randomly floating fibers and other air borne particles, then, even with the known designs conceived within allowable costs, it cannot be avoided that the said undesirable particulate enters into the drive enclosure. These particles, then, coming in at high velocities, agglomerate themselves into deposits and can thus lead to damage.

OBJECTS AND SUMMARY OF THE INVENTION

Thus, a purpose of the present invention is to create an apparatus, which can be manufactured at low cost and effectively blocks the infiltration of fibers into the drive enclosure and, in this way, contributes to the greater life of the drive assemblies. Additional objects and advantages of the invention will be set forth in part in the following description, or may be obvious from the description, or may be learned through practice of the invention.

This purpose can be achieved by the features of the invention wherein the drive enclosure holds at least one blower possessing at least one suction side and by the interposition of a filter in communication with the surrounding atmosphere and/or with a suction system of a stretch works, and/or with a ventilation system of a drive, in particular of a principal drive, and terminates with its discharge side within the drive enclosure. By the use of a blower, a pressure in excess of atmospheric is generated, which so acts, that within the entire peripheral line of the top, air within the said top is expelled outwardly into the air surrounding the drive enclosure. Under these conditions, there are then no uncontrolled air flows penetrating the drive enclosure and at the same time, no undesirable fibers and other air borne particulate infiltrating the enclosure. The drives in this case, will not be negatively affected in their durability or function by deposits of said fibers and particulate.

The invention makes possible the use of existing stretch machine equipment. The air flows engendered by the invented apparatus through the connection to a blower are a significant and effective employment of air circulation.

Beyond this, the invention does not make it imperative to undertake changes in the construction and concepts of a stretch machine. In a like manner, existing stretch machines can be retrofit at little cost. Especially favorable, economy-wise, is a situation where, for operation in accord with the invention, blowers already in place in the drive enclosure or for the main power drive, can be used. This leads to substantial cost reductions.

Further advantages can be gained when the suction side communicates with the upper or under zones of the drive enclosure, that is, less contamination is infiltrated into the upper zone of the drive enclosure, because at that location far less air borne particulate is present. If the suction intake is placed in the under zone, then, by the application of a large area for said suction intake, a low flow velocity may be selected, so that in this case, even less air borne particulate will be pulled in. This kind of a sizable intake is particularly practical, when the drive enclosure is set on a stationary base.

Principally, the placement and orientation of the blower in the drive enclosure is entirely optional. However, in regard to the economy of handling air, consideration should be given to a sensible placement solution by a design wherein the air distribution apparatus is provided in the drive enclosure and is so oriented, that the blower provides an essentially equal effect in the entire peripheral area of the top. By means of the air distribution apparatus, one can succeed in directing the air exactly to those locations where a cleaning and lint removal function can take place.

Because of the design of certain components, the deposition of dust and particulate cannot be prevented at many points. These deposits can be avoided now by means of the invention.

To ease maintenance work, a development of the apparatus wherein the blower is affixed to the top and movable therewith is of advantage, since the blower, when the top is opened, will not block access to other equipment placed in the drive enclosure. To take this further, to lessen the effort on the part of the maintenance person, it is sensible to arrange the apparatus such that the blower is in proximity to the pivoting axis of the top.

A simple cleaning of the filter can be achieved, in accord with the present invention, by a design of the apparatus wherein the blower is provided with a control apparatus for the reversal of its direction of rotation. Since, during certain operations on the stretch machine, for instance during the exchange of filled cans vs empty cans, a substantial number of the drives arranged in the drive enclosure need not be operating, then it becomes advantageous if the invented apparatus is enhanced through an expedient design of the control system, wherein the running time of the blower is reduced to an absolute minimum.

A favorable arrangement of a filter is in a maintenance service side of the machine, by which its accessibility is essentially improved. In the most simple case, it is sufficient, if the deposit of lint, which in the course of time builds up on the filter from the air borne particulate, is simply blown off and falls to the floor. Yet it is advantageous if a design wherein a lint catching box is provided for the filter on the outer side of the drive enclosure is provided for the environmentally safe removal of the lint. In order not to obstruct the operations of the maintenance person, a design of the invented apparatus wherein the filter or the side of the lint catching box remote from the stretch machine terminates evenly with the outer side of the stretch machine can be provided. An improvement of the invention recommends itself wherein the lint catching box is connected to a suction line. The joining location of the lint catching box and the suction line is provided essentially in the separation plane between the top and the stationary part of the stretch machine. Again, a useful connection fitting is provided for the removal apparatus wherein the suction line is provided with a shutoff valve which is connected to the control apparatus which regulates the rotational direction of the blower.

Within the concepts of the present invention, the term "blower" encompasses a great number of such devices as appropriate for placement in the drive enclosure. This also applied to "top" wherein the terms "doors" and "covering lids" may be included.

Going on, a multiplicity of correspondingly designed drive enclosures can be provided, in case, from the standpoint of available space, a selection therefrom might be acceptable.

The invention is simple in construction and operates, however, with considerable security against the infiltration of fibers and other air borne particulate. In this manner, the invention acts with simple means toward an increase of operational reliability of the drive mechanisms and toward an extension of their operational life. By means of the produced air flow within the drive enclosure, additionally, a cooling effect of the drive mechanisms and the associated equipment is achieved.

Further details and features of the invention are explained with the help of the drawings.

DETAILED DESCRIPTION

Figure 1:
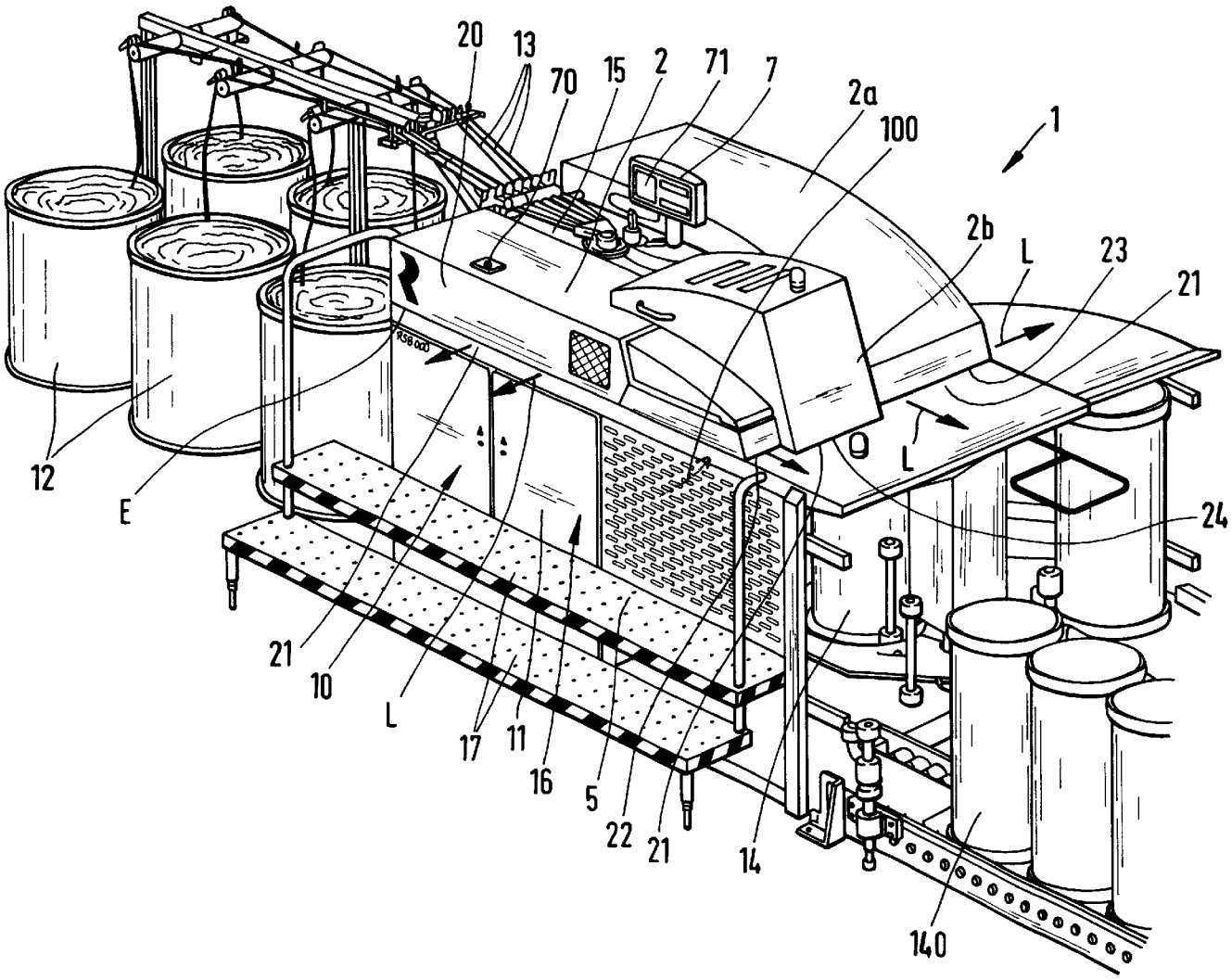
FIG. 1 is a perspective view of a stretch machine designed in accord with the invention.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield still a third embodiment. It is intended that the present invention include such modifications and variations as come within the scope and spirit of the present invention.

In order to obtain a better understanding of the essence of the invention, first, with reference to FIG. 1, a stretch machine will be explained in broad terms.

The under portion 10 of this stretch machine 1 is stationary and incorporates a machine support framing which is designed in the conventional manner, and possesses the indicated doors 11 and the like. On the left side of the figure are to be recognized several cans 12 from which the bands 13, which are to be stretched, are fed to the stretching machine 1. The bands 13 are brought together in a band conduit 15 (doubled), drawn and then run-out into a can 14.

Various drives—which will be later described in connection with FIG. 2—are required for the various activities on the stretch machine 1, such as the drawing (stretching) of the bands 13, the monitoring of the bands which were drawn to be delivered to can 14 by said drawing, the exchange of a filled can for an empty one, which latter is to be found in a wait-station 140 etc.

Most of these drives are found in a single enclosure (drive enclosure 3) which are covered by tops 2, 2*a* and 2*b*. The number of tops will be dependent upon design of the stretch machine 1 and can, therefore, vary from one stretch machine type to another.

The tops 2, 2*a* and 2*b* are respectively swingable about an axis, which is not visible in the illustrations, so that the drives in the mentioned drive enclosure 3 (see FIG. 2) are accessible for maintenance purposes.

Further drives or drive elements can be encased in one or more additional drive enclosures, the interiors of which can be reached by opening a door 11 (FIG. 1). For instance, this serves in the said apparatus for the exchange of the cans 14, 140 (can change apparatus 35).

Figure 2:
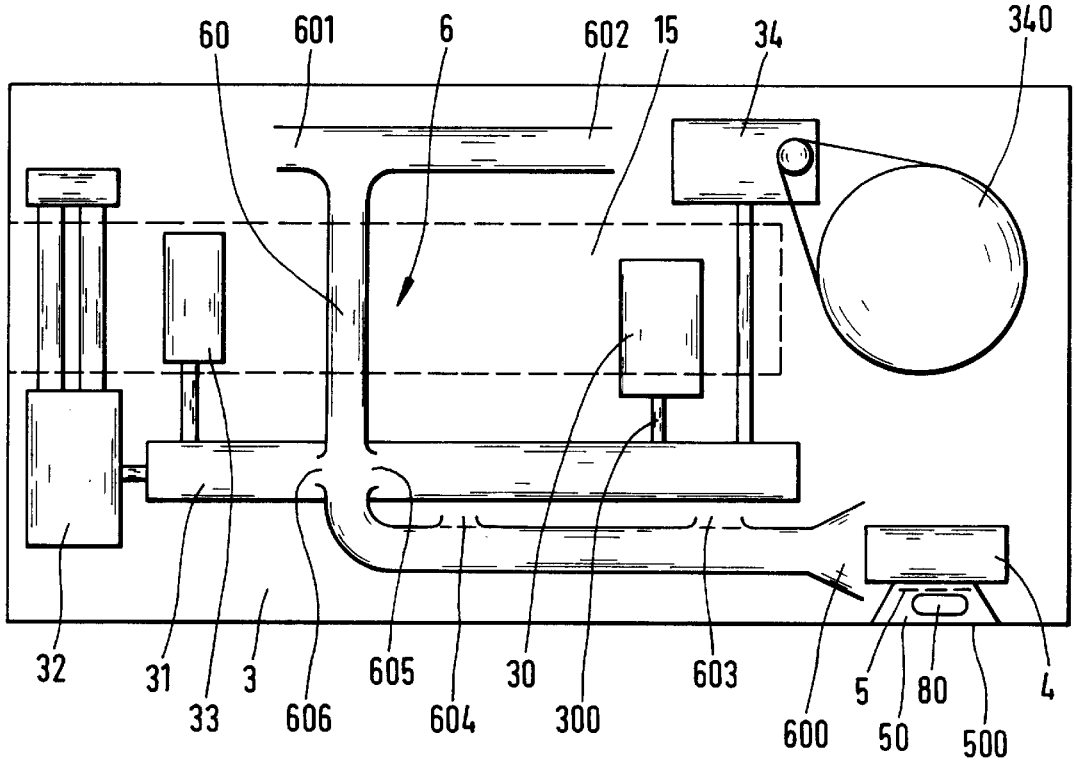
FIG. 2 is a schematic presentation of the drive enclosure of a stretch machine

For illustrative purposes, in FIG. 2, the drives, etc. are principally depicted as rectangles, however, it is to be understood that these rectangles indicate gear and other drives of conventional types with corresponding numbers of the various main and other gears, chains, drive mechanisms and the like. Furthermore, in this matter, as a rule, no inner encapsulation or the like is to be found within the drive enclosure 3. In accord with the embodiment example shown in FIG. 2, this drive enclosure 3 encloses a primary power drive motor 30, the main drive shaft 300 of which is connected to the subordinate drive 31. Through this drive 31, in the depicted example,—the drive 31 being a transmission which can be of any chosen design—are driven, a stretch work drive 32, a drive mechanism 33 for the band guide, as well as a turn-table drive 34.

Above the can 14, which to be filled, is located the said turn-table 34 which is set in motion while the filling procedure is running in order to equally distribute the finished fiber band into the said can 14. Further drives, for instance for the mentioned can exchange apparatus 35, (see FIG. 3) can be branched off of drive 31, even when these drives are located in another, separate drive enclosure (or a multiple thereof).

The mentioned drives (30, 31, 32, 33, 34) contain a plurality of turning and rotating components, which, within the drive enclosure 3 are not encapsulated again, but because of the necessary accessibility and heat dissipation are arranged openly in the drive enclosure 3.

The blower 4 is affixed to the top 2 in such a way that it moves therewith. In the depicted embodiment, at its suction side the blower 4 is directly flanged to the sidewall 20 of the top 2. A blower intake air filter 5 is installed in the said sidewall 20 of the top 2 so that none of the randomly floating fibers or airborne particulate from inside the stretch machine 1 can find its way into the drive enclosure 3. The blower, in this way, receives only clean, filtered air which is thereby free from fibers, fiber shreds, and other air borne particulate. On this account, only filtered air reaches the interior of the drive enclosure 3.

Before the control and further details of construction of the apparatus are examined, the functioning of the equipment should be presented.

During normal operation of the stretch machine 1, the main motor 30 is running and through the transmission 31, together with the stretch work drive 32, drives the stretchwork (not shown) for the tensioning of the bands 13. Coacting with the drive apparatus (33), the transmission 31 drives the band guide (also not shown) and energizing the turn-table drive 34 drives the turn-table 340.The blower 4 is also driven with its suction side pulling clean air in through filter 5 and on its discharge side blowing said air into the drive enclosure 3.

This air generates a pressure in the drive enclosure 3 in excess of the ambient air surrounding enclosure 3. This leads to the situation in which the air in the drive enclosure 3 escapes the enclosure 3 through combined cracks and gaps 21 in its effort to create a balance between the air in the drive enclosure 3 and that air in the surrounding space outside of the drive enclosure 3. At these places at which the air can escape from the drive enclosure 3 (see arrow "L") on the peripheral edges of the top 2, 2*a* and 2*b* where the said top 2 lies upon the stationary portion 10 of the stretch machine 1, no gasketing or other sealant means is provided, since these points of emission of air are desirable in order to achieve the desired effect. The air which issues forth from the cracks and gaps 21 prevents—except directly through the blower 4—that at any location, air, that is unclean air, can come into the drive enclosure 3 and thus bring in a contamination, which, as time goes on, can lead to damage to the driven parts of the drive assemblies including the gear drives.

Experience has shown, that when a pressure in the drive enclosure of ca. 300 to 400 Pascal is maintained, the desired action is assured.

As may be inferred from FIG. 1, the drive enclosure 3 possesses an angled shape, since it must partially enclose the band guide conduit 15. On this account, it is difficult under certain circumstances to maintain a constant, sufficient over-pressure around the entire peripheral edge of the top 2, 2*a*, 2*b*, that is, around the entire length of the separations and gaps between the said top 2, 2*a*, 2*b* on the one side and the stationary part 10 of the stretch machine 1 on the other. Achieving this over-pressure would surely exclude the influx of fibers and other air borne particulate into the drive enclosure 3.

Assistance can be obtained in various ways. For instance, a more powerful blower could be provided, which circulates a greater quantity of air and in that way, assures the reaching of the desired goal. This, however, has the disadvantage that the higher energy consumption carries a high price.

Another possibility arises in that the blower 4 could be located at a central point inside the drive enclosure 3, and appropriately oriented, so that the discharged air is distributed in the quickest possible time inside the drive enclosure 3 and thus also over the entire areas of the existing peripheral gap 21 between the top 2, 2*a*, 2*b* and the stationary section 10 of the stretch machine 1, and incidentally with equal intensity, the said air is expelled to the ambient atmosphere outside. In this case, if necessary, the blower 4 is to be connected at its suction side with an interposition of an appropriate (not shown) suction line transition piece with the suction opening in the top 2 which is covered by the filter 5.

In accord with a preferred embodiment of the described apparatus, and for that reason also depicted in FIG. 2, the blower 4, as shown in the first embodiment, is flanged onto the sidewall 20 of the top 2. Near to its discharge side, however, begins the opening 600 of a duct 60 which is a part of the air distribution system 6. The opening 600, as shown in the FIG. 2 embodiment, is widened into the shape of a funnel, which extends itself outwardly in the depicted widening direction, parallel to the longitudinal axis of the blower 4 and can encircle more or less around the circumference of the fan 4. In this way, the opening 600 of the tube 60 captures as much air as is desired in order to conduct this air through the duct 60 to the place in the drive enclosure 3 where over-pressure is required. The duct 60 branches in the depicted embodiment and possesses two outlet openings 601 and 602 which are directed against certain drives (30, 31, 32, 33, 34) and/or against those specific areas of the gap 21, which are insufficiently provided with over-pressure, because of their distance from the blower 4 as a result of the complex shape of the drive enclosure 3. In this way, the air distribution system 6 contributes to a uniform apportionment of the over-pressure in the area of the gap 21, and can then guarantee that nowhere can air infiltrate the drive enclosure 3.

The above discussions show that the invention is not limited to the type of design shown, but can experience a multiplicity of changes.

Thus, it is obviously possible to replace some or all features of the invention by equivalents, or even use said features in other combinations, without leaving the frame work of the present invention. Therefore, it is not a requirement that the air ductwork 6 shows essentially a single conduit 60. In the case that it is expedient, then two or more of the same kind of ducts in simpler or more complex forms are provided. Furthermore, it is not necessary that this duct 60 or these ducts 60 are closed over their entire full length. Since the air brought to the drive enclosure is helpful in cooling, it can be of advantage if especially fast rotating parts, or those parts which tend to heating on other grounds, are additionally cooled by air directly guided against them. In addition to the purpose to create a uniform distribution of over-pressure in drive enclosure 3, the following designated parts of FIG. 2 serve in this respect, i.e 603, 604, 606, 606.

The air distribution system 6 need not unconditionally exhibit a pipe or a pipe system. Instead of this, one or more sheet metal guidance vanes or other devices of this type may be used.

It has already be remarked above that the blower 4 can be located at an optional place in the drive enclosure 3. This is true unless its orientation and the design of a specific air distribution means allows the cracks and gaps 21 to maintain a satisfactory over-pressure in the entire area of the drive enclosure 3. In this matter, it is especially important, when considering the function of the blower, whether or not the blower 4 is supported from from the stationary part 10 of the stretch machine 1 or is supported in another manner, since the said blower is swingably connected to the top 2 (or 2*a*, 2*b*). The latter type of support is especially advantageous, since by swinging up the top 2, 2*a*, 2*b* which carries the blower with it, then this blower 4 is also swung up and is freely accessible for maintenance.

The arrangement of the blower 4 in a corner of the drive enclosure 3 makes little sense, as can be inferred from the foregoing description, since, as a rule, the desired over-pressure distribution can be achieved only at a greater expense, i.e. a more costly air ducting system.

Nevertheless, a particular layout is advantageous, in which the blower 4 is carried by a top 2, 2*a*, 2*b*, as long as it is not found centrally disposed within the drive enclosure 3, but in the nearest possible location to the swinging axis of the respective top 2, 2*a* 2*b*. In the stretch machine shown in FIG. 1, the (not shown) swinging axis of the said top 2, 2*a*, 2*b* is generally provided near the edges 22, 23, 24 thereof, on which account, in accord with the view given here in FIG. 1 of a general arrangement, the blower 4 which, as may be seen from the presentation of filter 5, is in proximity to the edge 22 of the top 2 and is carried by this said top 2. With this arrangement, the blower 4 is found at the closest possible distance to the center of gravity of the top 2, so that the maintenance person is not hindered in his work due to the weight of the said blower 4. Moreover, this weight, giving consideration to its suspension in the top 2, can be compensated for by an appropriately selected spring (not shown) or the like.

Since the space around the stretch machine 1 is not free from fibers, fiber fragments, or other light air borne particulate, and the filter clogs itself therewith after a given period, it becomes necessary to clean the filter on its intake side from time to time. This can be done manually. Following are the grounds that, in accord with the depicted embodiment in FIG. 1, the filter 5 is installed on the side in proximity to the maintenance side 16 of the of the stretch machine 1. On this side is also found a walkway 17 which eases the maintenance on the stretch machine 1, especially the accessibility to the drive enclosure 3. If the blower 4 is carried by the top 2, then the filter 5 finds itself, on this account, in the side wall 20 of the top 2. If the blower 4 is not carried by the top 2, then the filter 5 is built into the sidewall 100 of the stretch machine 1.

Today, modern textile machines function automatically, so that scarcely any maintenance work is to be carried out by maintenance people. Thus, the effort is made to have the cleaning of the filter 5 done not by hand, but automatically. For this purpose, the blower 4 is provided with a control device 71 (see FIG. 1) for short-period reverse operation. Advantageously, for this filter cleaning a period of less than five seconds is assigned, which will be later explained in more detail.

By means of the temporary run of the blower 4 in reverse rotation as compared to normal rotation, air is pulled out of the drive enclosure 3, and ejected into the surrounding ambient air through the filter 5 of the stretch machine 1. When this happens, the lint, which has built up on the outside of the filter 5 is blown away from the outside of the said filter and eventually settles.

Such a cleaning process can be coupled with some operations on the stretch machine 1, namely the exchange of a full can 14 for an empty can 140 already in the queue line (this being can-exchange). This cleaning operation can be carried out depending on the band length from the stretch machine run to the goods receipt in can 14. For instance, in this respect, a length of ca. 10,000 meters of band, which corresponds to about a three-time can exchange. Another alternative for carrying out the filter cleaning operation is to do the cleaning on a time-related basis, for example, every 20 minutes.

The controllability of the blower 4 is explained in the following, with help from FIG. 3. This illustration—without consideration of the actual space requirements of the individual components—shows the blower 4, which is connected to the control apparatus 71 by lines 710. In accordance with the desired control of the blower 4, this control apparatus 71 possesses a time control device 72. This has, for instance, a first push button 720 for the control of the time interval between the individual filter cleaning procedures, and a second push button for the adjustment of the running period of the blower 4 in the cleaning direction, that is, in a direction oppositely set to the normal operational direction. For the blowing away of the lint, from the outside of the filter 5, a short blast of air suffices. Since the air pressure in the drive enclosure 3 should be always higher than that of the ambient atmosphere around the said drive enclosure 3, to make sure that no undesirable air borne and fiber fragment particulate can penetrate through the cracks and openings into the drive enclosure 3, the blower 4 is run for only a short time in the filter cleaning direction, that is, reverse of normal operational rotation. Within this short time of preferably five seconds, the over-pressure in the drive enclosure 3 is reduced only an insignificant amount.

On this account, the over-pressure in the drive enclosure 3 remains in a sustained condition, which excludes air and contamination from entering through the crack 21 into the said drive enclosure 3.

The control apparatus 71 is in communication with another control system 7 which regulates the operation of stretch machine 3 itself. This additional control system 7 is in connection with the main drive motor 30 by the electrical line 700, and by the line 701 makes connection with the can exchange apparatus 35 for the exchange of a full can 14 for an empty can 140 (see FIG. 1), and finally connects through line 702 with a final filter 18.

The achievement, based on this controlling connection of the control systems 7 and 71, is that the blower 4 is always set into operation when the stretch machine 1 starts to run and is stopped when the stretch 1 is shut off. By this means, during the entire operational period of the stretch machine 1, that is during the entire time during which drive elements in drive enclosure 3 are in operation, the desired over-pressure is being produced. This on-off switching of the stretch machine and the blower 4 is done with the help of a switch button 70 connected by means of line 703 with the control system 7.

Mention has already been made above that the lint accumulating over time on the outside of filter 5 is, from time to time, blown away, which can be controlled in various ways. As shown in the embodiments depicted in FIGS. 2 to 4, a lint catcher box 50 is affixed to the outside of the drive enclosure 3 so that lint does not fall to the floor. Now, if the lint is blown from the outside of the filter 5 as a result of the reversal of the rotation of the blower 4, then the lint will fall into the lint catcher box 50 by the force of gravity, whereupon, at optional times, possibly at set time intervals, the lint can be environmentally safely removed.

As the length of the scaffold 17 shows, the operator or the maintenance person can walk back and forth along the stretch machine 1 in order to reach all machine groupings of the stretch machine 1. With this in mind, interfering components or elements, which protrude over the outer contour of the stretch machine 1, on which the operator or maintenance person can catch themselves are disturbing.

Figure 4:
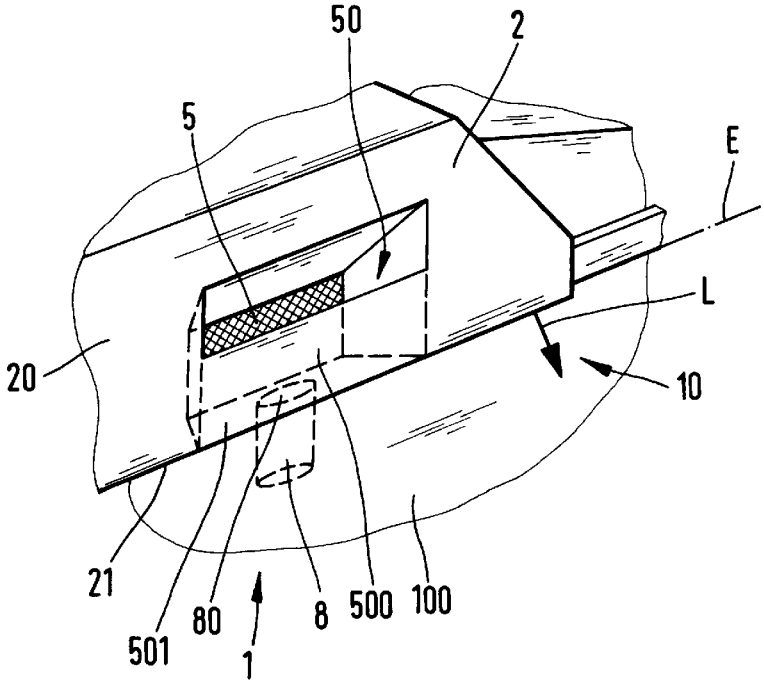
FIG. 4 is a perspective view of the invention.

In order to avoid difficulties therewith, in accord with FIG. 1, provision has been made that the filter 5 aligns essentially flush with the outside of the stretch machine 1. As seen in FIGS. 2, and 4, which both respectively show a lint catcher box 50 affixed to the filter 5, this said box 50 is so designed, that its outer side 500, that is, its side remote from the stretch machine 1, or the drive enclosure 3 thereof , essentially runs in alignment with the said outer side, or contour of the stretch machine 1, that is, the top 2 thereof (the top 2 being a part of the stretch machine 1). To this purpose, the lint catcher box 50 is designed as a recess in the side wall 100 of the stretch machine 1, that is designed into the side wall 20 of the top 2.

In order to avoid a manual emptying of the lint catcher box 50, which is very labor intensive in the case of large equipment with a multiplicity of stretch machines 1, in accord with FIGS. 2 and 4, the lint catcher box 50 is connected to a suction line 8. Principally, this suction line 8 can open into the lint catcher box 50 in any optional manner, i.e. from the side, from the bottom, etc. See FIGS. 2 and 4 for a representation one way, and FIG. 3 for a representation the other way.

If the blower 4 is placed in the top 2, this allows a simple design to be achieved, since in the manner (see FIG. 4) in which the bottom 501 of the lint catcher box 50 is formed by a surface of the stationary part of 10 of the stretch machine 1, while the filter 5 and the side walls (see the outer wall 500 in the FIGS. 2 and 4) are part of the top 2. In this bottom 501 of the lint catcher box 50, is found the entry opening of the said suction line 8. In this way, the separation line between the lint catcher box 50 and the suction line 80 finds itself at the separation plane E between the top 2 and the stationary part 10 of the stretch machine 1.

It is not necessary, that the suction line 8 be held continuously under a low pressure. For energy saving reasons, it is advantageous to only maintain and generate this suction during the time interval during which the blower 4 runs in a reverse direction to normal operational rotation in order to blow away the collected lint on the filter 5.

Figure 3:
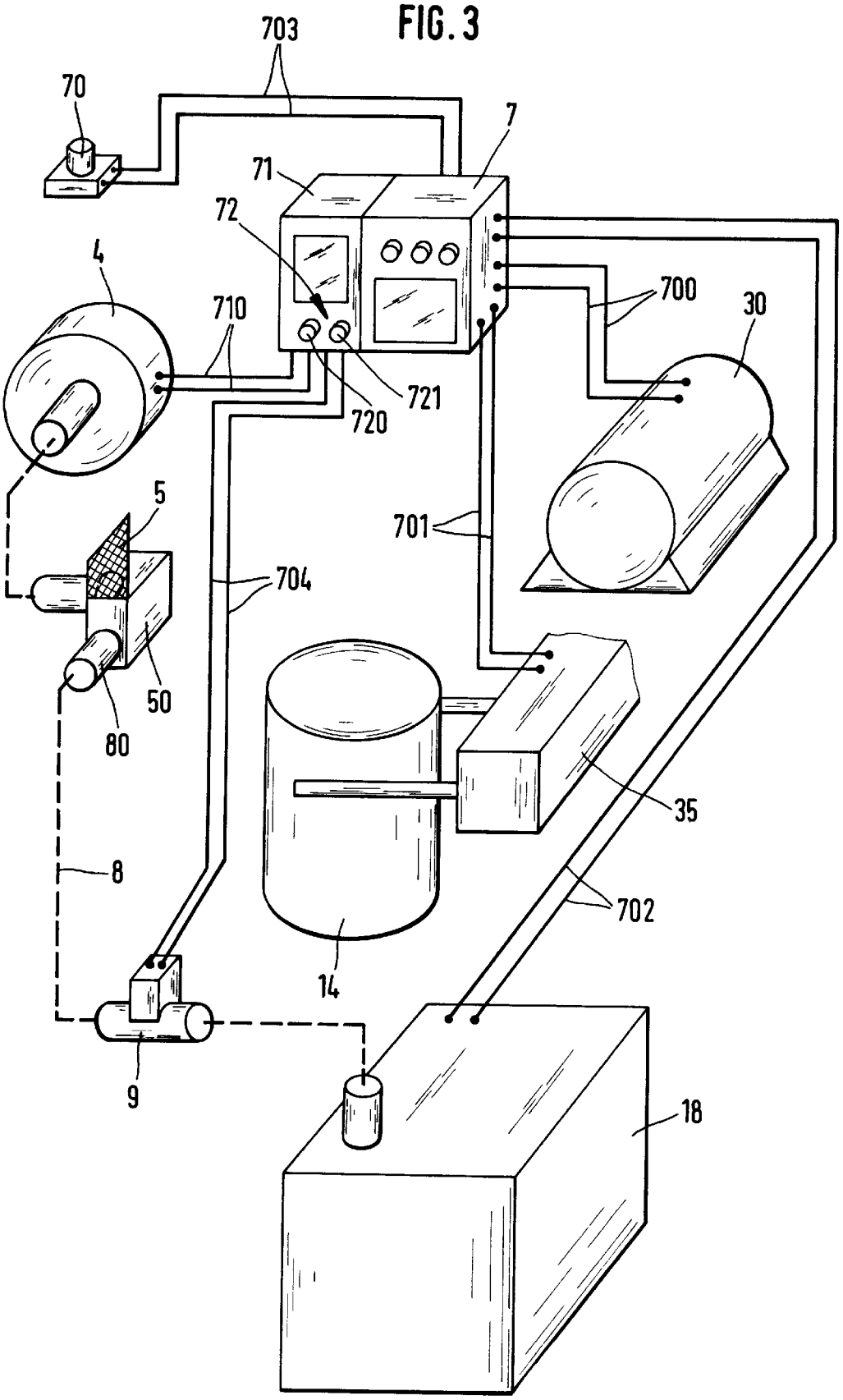
FIG. 3 is a control schematic for a stretch machine designed in accord with the invention, presented in a perspective view.

In accord with FIG. 3, on these grounds it has been provided that in the suction line 8 a shut off valve 9 in the form of a controllable valve is provided, which, when connected to line 704, is controllingly communicating with the control system 7 for the rotational reverse of the blower 4.

The effective under-pressure in the suction line 8 prevents lint from being blown away over the upper edge of the outer wall 500 of the lint catcher box 50, and obviates the necessity of designing this outer wall 500 to inconvenient heights in relation to the upper edge of the filter 5.

In accord with FIG. 3, a filter 18 is provided into which the suction line 8 opens and in which the air is passed through a filter apparatus (not shown) in order to clean said air. Such types of filter apparatus are conventional and form a so-called "filter box" and, as a rule, form a component of a stretch machine 1. This is not a prerequisite, and a filter box, if such is furnished, can also be constructed independently of the stretch machine 1 and can serve a multiplicity of textile machines in common.

The apparatus for the generation of an over-pressure in the drive enclosure 3 for the avoidance of disturbances as a result of infiltrating fibers and air borne particulate has been explained in the foregoing in connection with a drive enclosure 3 covered by a pivotable top 2, 2*a*, 2*b*. It is obvious that within the framework of the present invention, a blower 4, with a filter connected thereto, can be provided for the same purpose also in another, possibly additional drive enclosure which achieves said enclosure by closed doors 11 etc. In this case, when necessary, there can be provided also for several drive enclosures, a single blower 4 with correspondingly several air distribution systems 6, or yet a single suction connection in the outer wall of the stretch machine 1 with a single filter 5 serving a multiplicity of blowers 4.

It should be apparent to those skilled in the art that various modifications and variations can be made in the present invention without departing from the scope and spirit of the invention. It is intended that the present invention include such modifications and variations as come within the scope of the appended claims and their equivalents.

We claim:

1. A textile machine for processing fibers, comprising a drive mechanism disposed within a drive enclosure; said drive enclosure having a movable top having edges that contact against parts of a stationary frame of said textile machine; said drive enclosure further comprising at least one blower having a suction side taking suction through a filter from an area outside of said drive enclosure, and with a discharge side within said drive enclosure for maintaining a positive pressure within said drive enclosure so that air moves out of said drive enclosure between said edges and said stationary frame part to prevent fiber and debris from migrating into said drive enclosure.

2. The textile machine as in claim 1, wherein said suction side takes its suction from one of atmosphere surrounding said textile machine, a suction system of said textile machine, or a ventilation system for a drive of said textile machine.

3. The textile machine as in claim 1, further comprising an air distribution system disposed within said drive enclosure to deliver air from said blower within said drive enclosure.

4. The textile machine as in claim 3, wherein said air distribution system is configured to deliver air within said drive enclosure so that an essentially equal effect is generated uniformly around said edges of said top.

5. The textile machine as in claim 1, wherein said blower is mounted to said top and is movable therewith.

6. The textile machine as in claim 5, wherein said blower is mounted proximate to a pivoting axis of said top.

7. The textile machine as in claim 1, wherein said blower is reversible for cleaning said filter, and further comprising a blower control apparatus configured with said blower to controllably reverse its direction.

8. The textile machine as in claim 7, further comprising a control system for operational control of said textile machine, said blower control apparatus integrated with said control system.

9. The textile machine as in claim 7, wherein said blower control apparatus incorporates a time control device to set the reversal running time of said blower.

10. The textile machine as in claim 1, wherein said filter is disposed in a side wall of said stationary frame.

11. The textile machine as in claim 10, wherein said filter is recessed within said side wall so as not to extend beyond said side wall.

12. The textile machine as in claim 1, further comprising a lint catching box configured with said filter outside of said drive enclosure to catch lint blown off of said filter.

13. The textile machine as in claim 12, further comprising a suction line in communication with said lint catching box.

14. The textile machine as in claim 13, wherein said filter and said lint catching box are disposed in said top, and wherein said lint catching box joins said suction line generally where said top meets said stationary frame parts.

15. The textile machine as in claim 13, further comprising a controllable shutoff valve disposed within said suction line.

16. The textile machine as in claim 15, wherein said blower is reversible for cleaning said filter, and further comprising a blower control apparatus configured with said blower to controllably reverse its direction, said shutoff valve controlled by said blower control apparatus.

17. The textile machine as in claim 13, wherein said suction line discharges into a filter apparatus.

* * * * *